US009955723B2

(12) United States Patent
Zannini et al.

(10) Patent No.: US 9,955,723 B2
(45) Date of Patent: May 1, 2018

(54) COVERED ASHTRAY

(71) Applicant: Archimedes Invent Group, LLC, Pembroke Pines, FL (US)

(72) Inventors: Anthony A. Zannini, Pembroke Pines, FL (US); Don Salerno, Dania Beach, FL (US)

(73) Assignee: Archimedes Invent Group, LLC, Pembroke Pines, FL (US)

( * ) Notice: Subject to any disclaimer, the term of this patent is extended or adjusted under 35 U.S.C. 154(b) by 673 days.

(21) Appl. No.: 14/559,217

(22) Filed: Dec. 3, 2014

(65) Prior Publication Data

US 2015/0296880 A1 Oct. 22, 2015

Related U.S. Application Data

(63) Continuation-in-part of application No. 13/663,796, filed on Oct. 30, 2012.

(51) Int. Cl.
*A24F 19/00* (2006.01)
*A24F 13/22* (2006.01)

(52) U.S. Cl.
CPC ..... *A24F 19/0035* (2013.01); *A24F 13/22* (2013.01); *A24F 19/0085* (2013.01); *A24F 19/0092* (2013.01)

(58) Field of Classification Search
None
See application file for complete search history.

(56) References Cited

U.S. PATENT DOCUMENTS

| | | | | |
|---|---|---|---|---|
| 1,530,599 | A * | 3/1925 | Hampson | A24F 19/00 131/240.1 |
| 1,571,003 | A * | 1/1926 | Genaille | A24F 19/0064 131/239 |
| 2,138,983 | A | 12/1938 | Rich, Jr. | |
| 2,626,613 | A * | 1/1953 | Glance | A24F 13/16 131/174 |
| D292,028 | S | 9/1987 | Rhodes | |
| 4,897,033 | A | 1/1990 | Yang | |
| D387,473 | S | 12/1997 | Angelakos | |
| 5,967,312 | A * | 10/1999 | Jacobs | A24F 23/04 131/329 |
| 6,682,117 | B2 | 1/2004 | Sloan et al. | |
| D616,178 | S | 5/2010 | Baggenstos | |
| 2004/0216753 | A1 * | 11/2004 | Fox | A24F 15/18 131/242 |

* cited by examiner

*Primary Examiner* — Eric Yaary
(74) *Attorney, Agent, or Firm* — Kevin P. Crosby; GrayRobinson, P.A.

(57) ABSTRACT

A covered ashtray having an opening in one sidewall or a cover thereof, which permits a tip of a lit smoking article, such as for example a cigar or cigarette, to be suspended within the interior of the ashtray. Retention structure may be provided to securely retain the smoking article in position in the opening. The housing and cover may be manufactured as a single unit, or separately, and later connected. Preferably, at least a portion of the cover or housing is openable (e.g. hinged or completely removable) to permit emptying the contents of the ashtray.

16 Claims, 6 Drawing Sheets

COVERED ASHTRAY

RELATED APPLICATION DATA

This application is a continuation-in-part of and claims priority to co-pending Utility application Ser. No. 13/663,796 filed on Oct. 30, 2012 and entitled "Covered Ashtray." This application is also a continuation-in-part of and claims priority to co-pending Design application Ser. No. 29/458,543 filed on Jun. 20, 2013 and entitled "Ashtray." The contents of those applications are fully incorporated by reference herein for all purposes.

BACKGROUND OF THE INVENTION

Field of the Invention

This invention relates generally to ashtrays, and, more particularly, relates to a covered ashtray having means to suspend the lit end of a cigar or cigarette within an interior of the ashtray.

Description of the Prior Art

When smoking a cigar or cigarette, particularly within confined spaces such as inside a building or motor vehicle, the smoke which emanates from the lit end of the cigar or cigarette dissipates, filling the space, and potentially causing discomfort to those who are not smoking.

In addition, ashtrays are used to collect the ash material which inevitably falls off of the lit end of the cigar or cigarette.

Any receptacle can be used to collect such ashes. However, no previously proposed ashtray permits the lit end of the cigar or cigarette to be suspended above the ash receptacle, while simultaneously entrapping the smoke emanating from said lit end.

It is, therefore, an object of this invention to provide an ashtray which is capable of securely suspending the lit end of a cigar or cigarette above an ash collecting area while the cigar or cigarette is lit.

It is also an object of this invention to provide an ashtray which entraps discharged smoke from the cigar or cigarette while said lit end is supported by the ashtray.

SUMMARY OF THE INVENTION

With these and other objects in mind, there is disclosed herein a covered ashtray having an opening in one sidewall thereof, which permits a lit cigar or cigarette to be suspended within the interior of the ashtray. Securement structure may be provided to securely retain the cigar or cigarette in position in the opening. The housing and cover may be manufactured as a single unit, or separately, and later connected. Preferably, at least a portion of the cover is openable (e.g. hinged or completely removable) to permit emptying the contents of the ashtray.

Additional apparatus and features may be employed in conjunction with the ashtray disclosed herein without departing from the spirit and scope of the invention. The features of the invention will be better understood with reference to the following drawings.

DETAILED DESCRIPTION OF PREFERRED EMBODIMENT(S)

Figure 1:
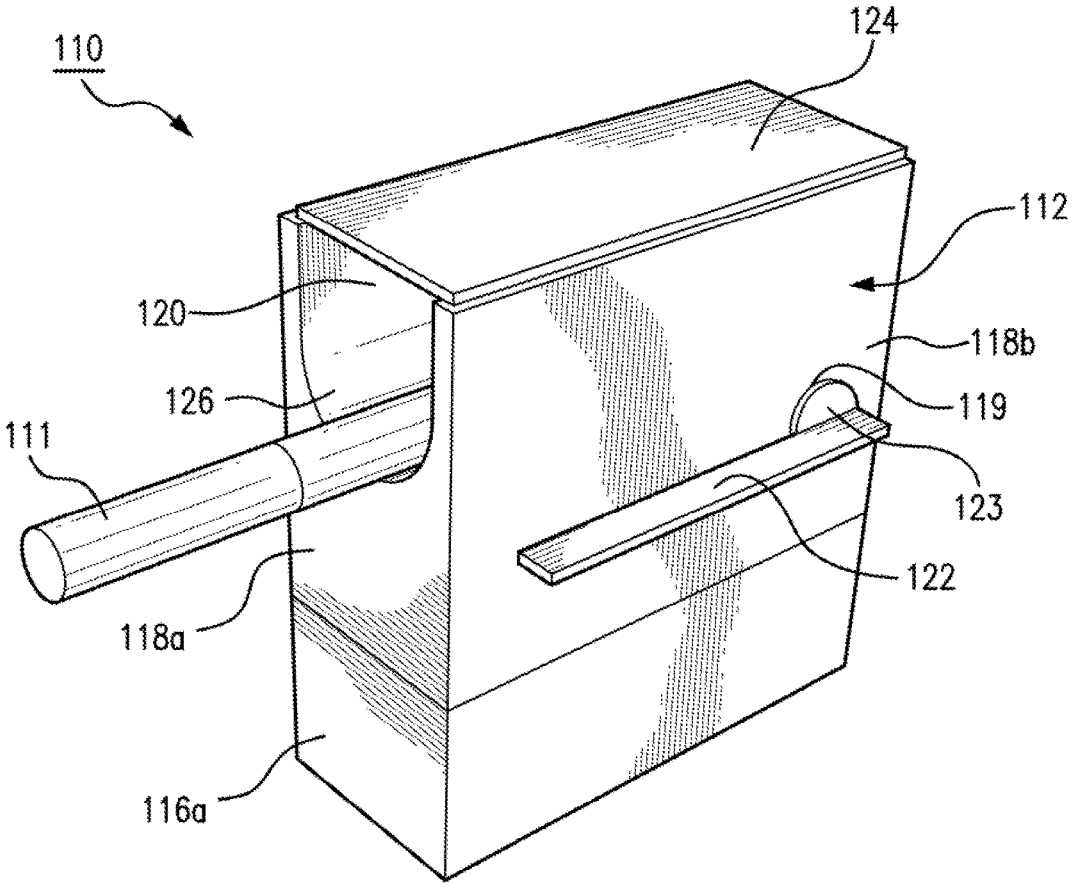
FIG. 1 is a front perspective view of an alternative embodiment of my invention.

Referring now to the drawings, there is shown a novel, smoke-entrapping, ashtray suitable for use under virtually any circumstances. In the preferred embodiment, the ashtray 10 is comprised of a housing 12, which may be of any shape (e.g. rectangular, square, round, triangular, etc.), and which defines an interior space 13 adapted to receive discharged ashes from a cigar or cigarette. In the embodiment shown, the housing 12 is comprised of a floor 16 and four sidewalls 18*a*-18*d*. Housing 12 defines an open top area or top opening 19, as well as a cigar/cigarette receiving aperture 20 defined by sidewall 18*a*.

A cover 24, which may have a shape that corresponds to the shape of top opening 19 of housing 12, is adapted to be placed over top opening 19 to thereby create a substantially sealed interior volume other than the receiving aperture 20.

A cigar/cigarette support 26 may be employed adjacent aperture 20 to support the lit end of a cigar or cigarette (not shown) within the interior space defined by housing 12 and cover 24. Support 26 may be integrally incorporated into sidewall 18*a* or cover 24, or may be secured thereto by mechanical fastener, such as screws, rivets, adhesive, or the like.

Figure 2:
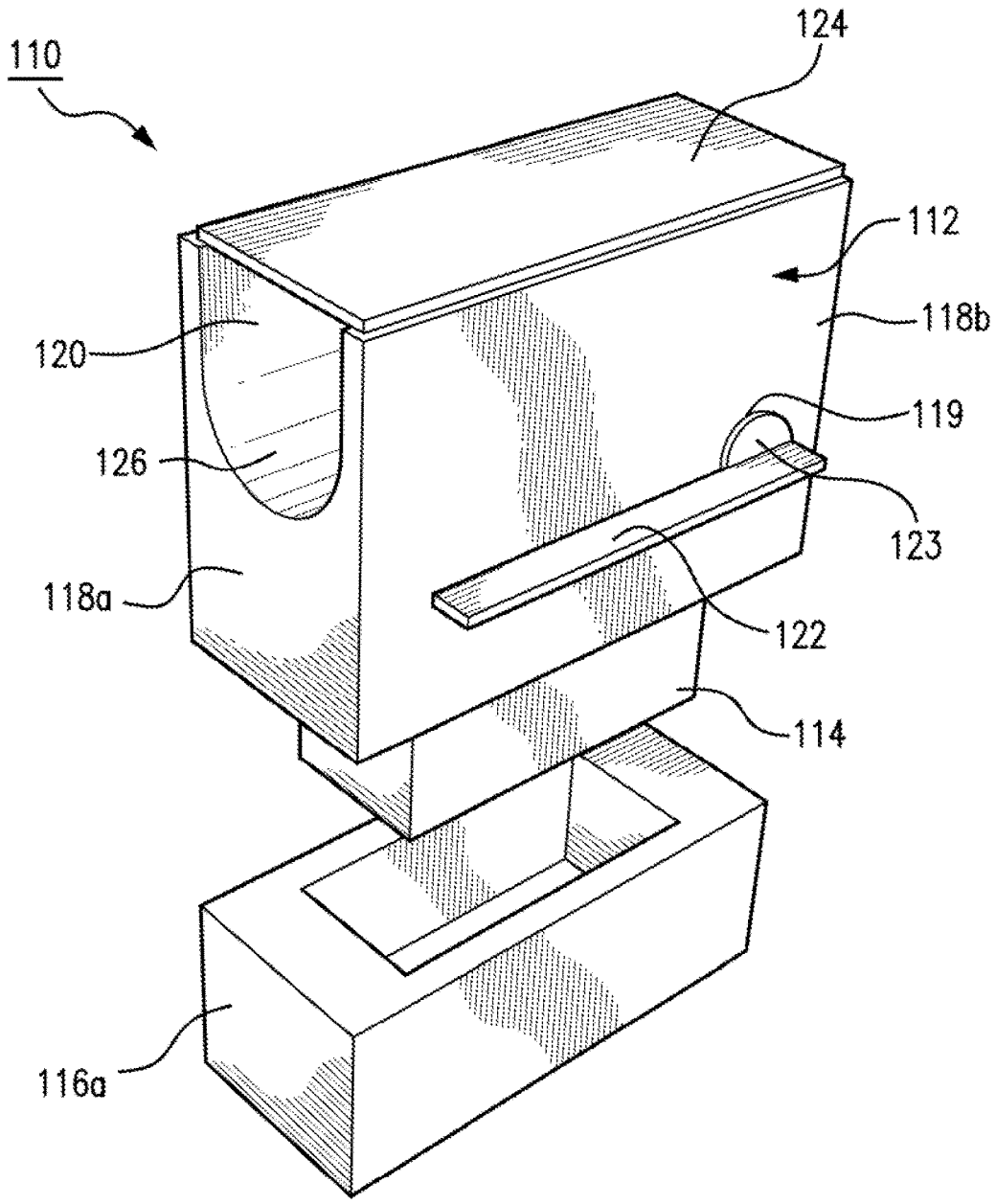
FIG. 2 is a partially exploded front perspective view of the embodiment depicted in FIG. 1.
Figure 3:
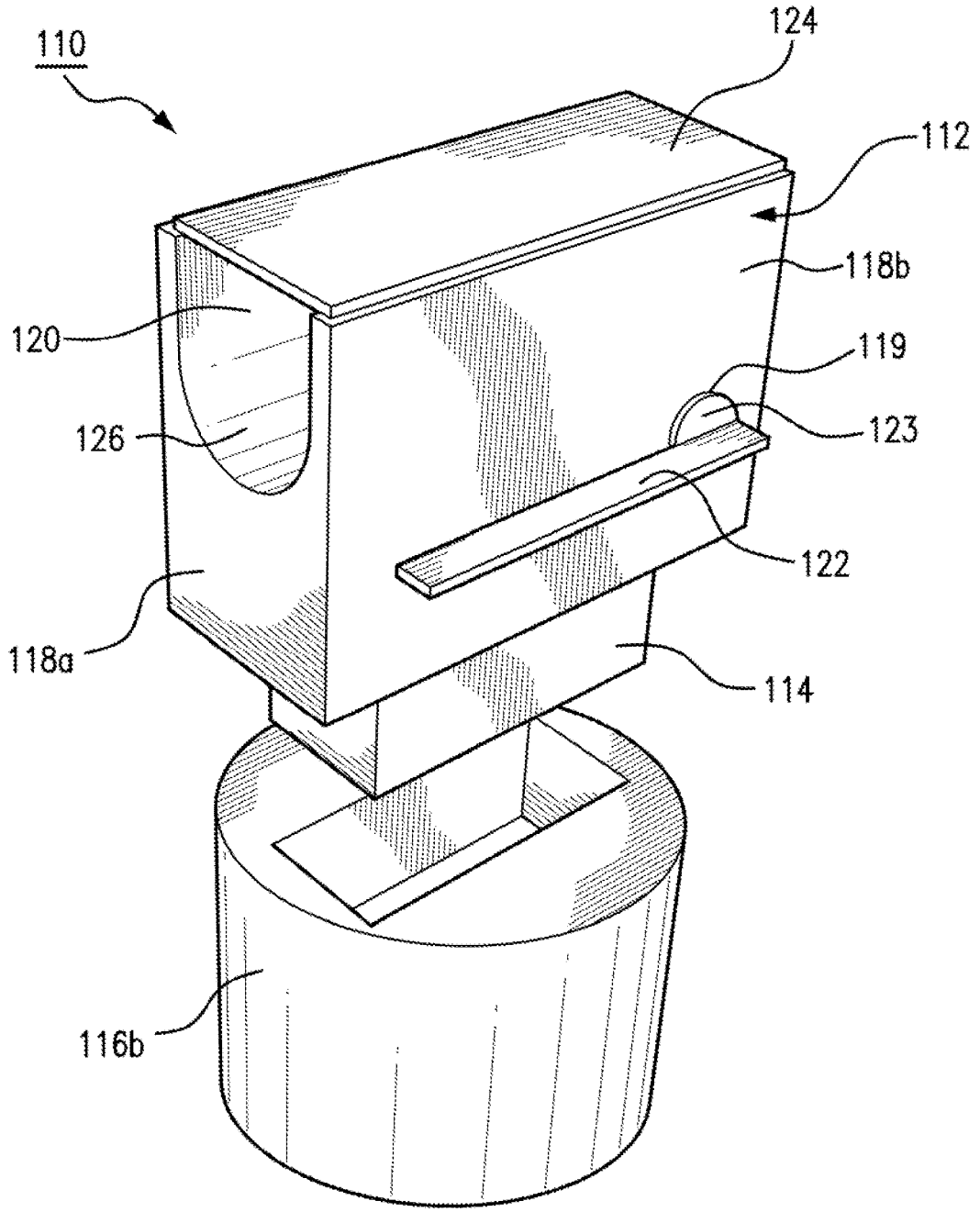
FIG. 3 is a partially exploded front perspective view of an alternative embodiment of my invention utilizing a circular base portion.

A cigar/cigarette securing or retaining apparatus, such as spring-loaded clip 28, may be associated with support 26 to retain a lit cigar or cigarette in position relative to aperture 20, housing 12 and cover 24. Clip 28 is hingedly connected to support 26, as by way of hinged support posts 31, 33. A pivot pin 35 is used to hingedly connect clip 28 to support posts 31, 33. Pin 35 is placed through apertures in clip 26 as well as corresponding apertures defined by support flanges 37, 39 of clip 28. Clip 28 may employ an arcuate upper member 42 and a lever 44 with which to open the clip relative to the support 26 so as to permit the insertion or removal of a cigar or cigarette. A biasing means such spring 41 is used in the embodiment shown to releasably retain clip 28 in the closed position shown in FIGS. 1,4-5. By pushing down on lever 44 against the action of spring 41, clip 28 can be opened, as shown in FIGS. 2 and 3 so that a cigar in association with the support 26 (if present) and/or aperture 20 is contemplated to be within the scope of this invention.

Support 24 may or may not define a recessed area such as semi-cylindrical cutout 50 therein to cradle a cigar or cigarette when retained through aperture 19.

Cover 20 may have a hingedly supported lid 25 to permit the contents of ashtray 10 to be emptied by inverting ashtray 10 and shaking it. Rather than, or in addition to, an openable feature in cover 24 such as lid 25, an openable structure (not shown) as will occur to those of skill in the art may be employed relative to housing 12 to permit access to the volume defined by housing 12 and cover 24.

Figure 4:
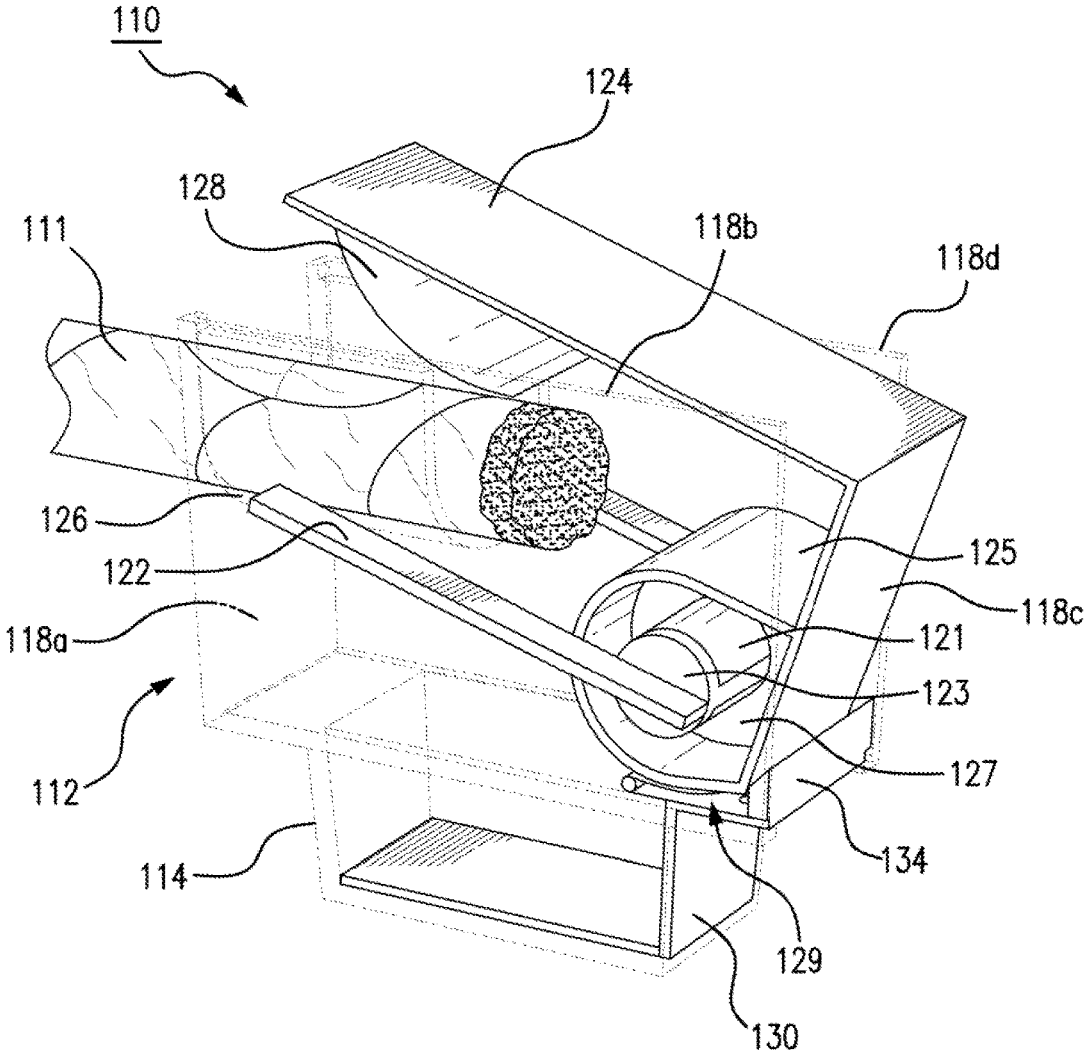
FIG. 4 is a partially transparent rear perspective view of an embodiment of my invention.
Figure 5:
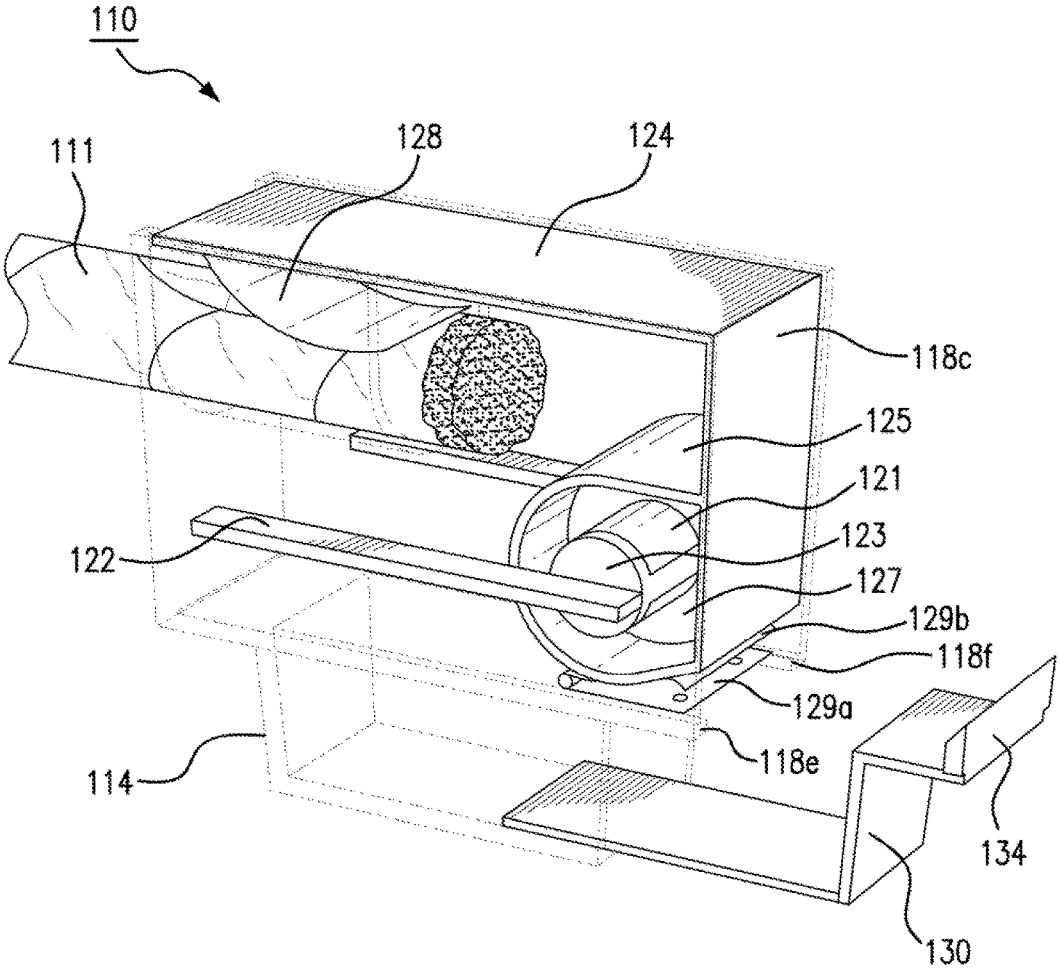
FIG. 5 is another partially transparent rear perspective view of an embodiment of my invention.

Cover 24 may be permanently affixed to housing 12, or be removable therefrom as shown in FIG. 4.

Figure 6:
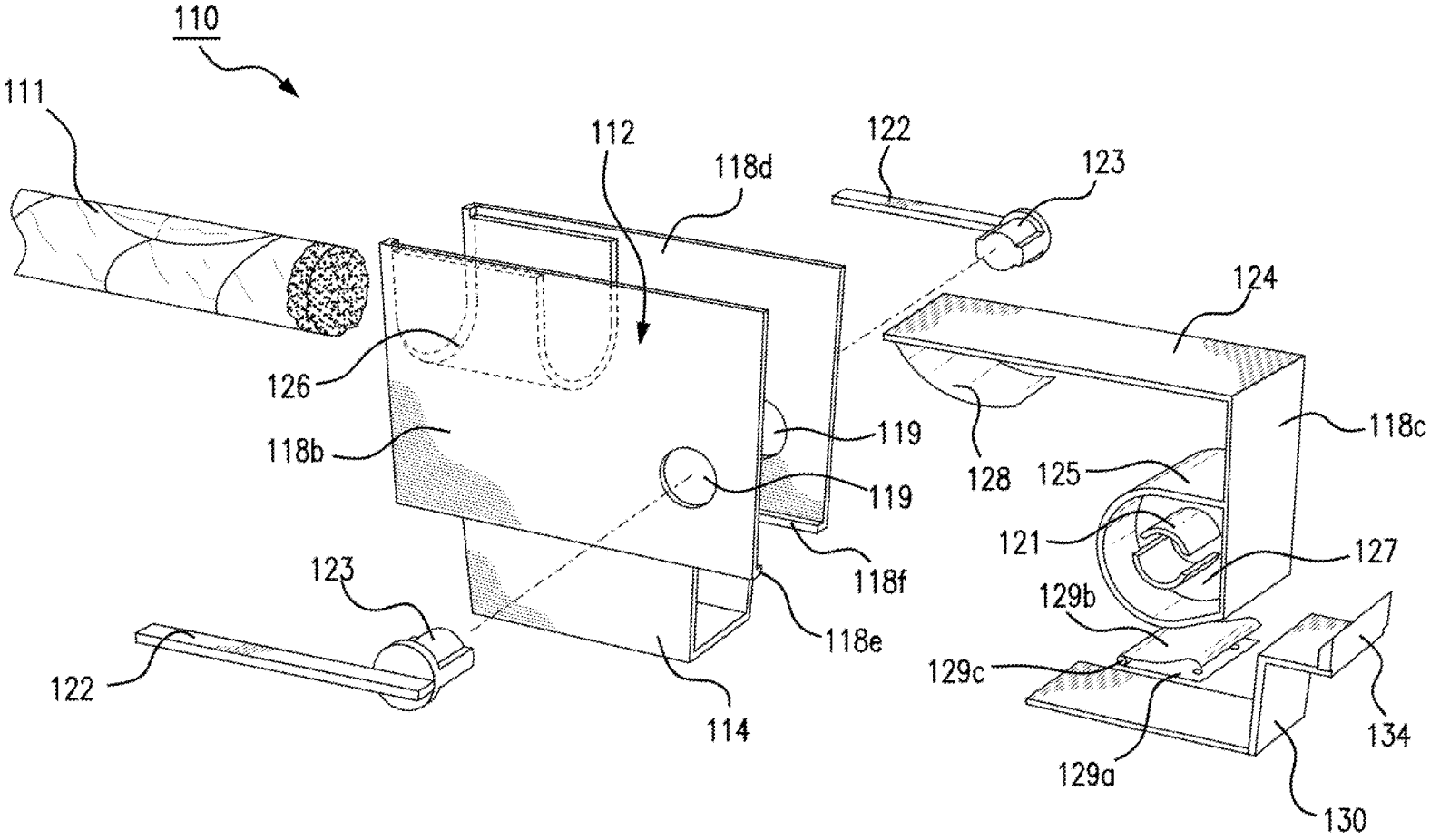
FIG. 6 is an exploded perspective view of an embodiment of the present invention.

Aperture 19 may be sized and shaped in any way, so long as it can accommodate a lit cigar or cigarette therethrough to cause the lit end thereof to remain within the space 13 defined by housing 12 and cover 22. Aperture 19 may take the form of an elongated slot such as that shown in FIGS. 6-7. Ideally, the smallest aperture should be used which will accommodate the largest size cigar that is likely to be used with the ashtray 10 of this invention.

Optionally, support 24 may be oriented at a slight angle relative to the horizontal so as to urge the cigar or cigarette placed thereon to nestle up against clip 26, providing a greater degree of security, particularly when the ashtray is mounted in a moving vehicle.

Attachment structure, such as fastener 32 (which may be hook and loop material, adhesive, magnet, clip, tongue and groove structure, etc.) for attaching housing 12 to a support surface may optionally be employed to permit removable (or permanent) attachment of the apparatus of this invention to a support surface such as an automobile console, window, dwelling wall, etc.

It is to be appreciated that the ashtray of this invention may be employed in any environment where smoking may occur, including moving vehicles. The enclosed space created by housing 12 and cover 22 entrap the smoke emitted by the lit tip of a cigar or cigarette, greatly reducing, or entirely eliminating, the second-hand smoke in the room/vehicle.

It is also to be appreciated that aperture 19 may be defined by any of the walls of housing 12, or by cover 22, or partially defined by a combination of both. There may be more than one aperture defined by housing 12 and/or cover 22 as well.

Alternative Embodiment

Another exemplary embodiment of the invention disclosed herein is depicted in FIGS. 13-18. With reference initially to FIGS. 13 and 14, one embodiment includes an ashtray 110, comprising a housing 112. The ashtray 110 is configured to receive a smoking article 111. By way of example, the smoking article 111 may comprise a cigar, a cigarette, a vaping device, or any other suitable smoking article 111. The housing 112 may include a receptacle 114 formed within its base for receiving ash from the smoking article 111. Further, in the embodiments depicted herein, the housing 110 includes one or more sidewalls 118*a*, 118*b*, and 118*d* (shown in FIGS. 16-17) upstanding from the receptacle 114. One or more of the upper edges of the one or more sidewalls 118*a*, 118*b*, and 118*d* form a top opening 121, which provides access to the interior of the ashtray 110. One or more of the one or more sidewalls 118*a*, 118*b*, 118*c*, and 118*d* may further comprise a side opening 119, the function of which is described in greater detail hereinafter.

In one embodiment, a cover 124 having interior and exterior surfaces and being adapted to be moved between first and second positions is provided. At least a portion of the cover 124 may be openable (e.g. hinged or completely removable) to provide access to the interior of the ashtray 110 and/or to accommodate large smoking articles 111, as will be described in greater detail hereinafter. Embodiments in which the cover 124 cannot be opened, however, are also considered to be within the scope of the present disclosure. As depicted in FIGS. 13-15, a first position of cover 124 may correspond to a closed orientation of the cover 124 with respect to the housing 112. Likewise, as depicted in FIG. 16, the second position may correspond to an open or partially open orientation. In the embodiment shown, rear sidewall 118*c* is integrally connected to cover 124 such that they move together when cover 124 is moved between the closed position shown in FIGS. 13-15 and 17 and the open or partially open position shown in FIG. 16. However, cover 124 and rear sidewall 118*c* may be hinged or otherwise articulated relative to each other such that only cover 124 moves between the closed and open positions. In embodiments in which the cover 124 is hinged or otherwise articulated relative to sidewall 118*c*, it is envisioned that sidewall 118*c* may be part of the housing 112. The cover 124 is adapted to fit over the top opening 121 of the housing 112. Further, in the embodiments depicted herein, the cover 124 may be in substantial sealing engagement with one or more of the upper surfaces of the sidewalls 118*a*, 118*b*, and 118*d* of the housing 112, thereby forming a partially enclosed volume bounded by the housing 112, the cover 124, and the receptacle 114. By forming a substantially enclosed volume, the ashtray 110 serves to both limit the amount of smoke emanating from the device and capture ash resulting from a burning smoking article 111. The cover 124 may further be integrally, hingedly or otherwise connected to one or more of the other sidewalls 118*a*, 118*b* and/or 118*d*.

In one embodiment, and with reference to FIGS. 16-18, the ashtray 110 may incorporate a shaft shield 125 operable with at least one journal 121, each journal 121 receiving at least one central shaft 123. The shaft shield 125 protects the central shaft 123 from falling ash and debris. The shaft shield 125 may be integral with the interior surface of the cover 124 or, alternatively, fixedly attached. One embodiment may further include a substantially vertically oriented interior partition wall 127 for operably connecting the at least one journal 121 to the shaft shield 125 and to rear wall 118*c*.

At least one lever arm 122 connected to a shaft 123 may be provided for engaging the at least one journal 121 through the corresponding side openings 119 formed within sidewalls 118*a* and 118*d*, respectively. In use, the shaft 123 rotates within the corresponding side opening 119. In the embodiments depicted herein, a pair of lever arms 122 are provided. However, use of a single lever arm 122 is considered to be within the scope of the present disclosure. Each shaft 123 should be non-rotationally engaged with a corresponding journal 121, such as by being formed to interfit with correspondingly shaped openings in the journal 121 such that rotation of the lever arms 122 relative to the journal 121 is prevented, which in turn causes the rear wall 118*c* and, in turn, cover 124 to rotate with the lever arms 122 through the interconnection of journal 123 with rear wall 118*c* via partition wall 127. Thus, each lever arm 122 is operable for disengaging the cover 124 from the upper edges of the one or more sidewalls 118*a*, 118*b*, and 118*d*.

A biasing member 129 engaging both the housing 112 and the shaft shield 125 may be provided for biasing the cover 124 in either of the first or second positions. The embodiments depicted herein are biased in the closed position, however additional improvements that permit the cover 124 to be biased in at least one of the open and closed orientations are considered to be within the scope of the present disclosure. The biasing member 129 may be comprised of first 129*a* and second 129*b* flanges joined by a torsion spring 129*c*, pin, or the like. In one embodiment, the first flange 129*a* may be shaped so as to substantially or partially mate with lower ledges 118*e*, 118*f* extending inward from sidewalls 118*b* and 118*d*, respectively, of the housing 112, and the second flange 129*b* may be shaped to rotationally guide a lower portion of the shaft shield 125. In one embodiment, and with reference to FIGS. 16 and 17, the biasing member 129 is positioned between the shaft shield 125 integrally formed from an interior surface of the cover 124 and a lower ledges 118*e*, 118*f* of the housing 112 adjacent the receptacle 114. The biasing member 129 may be either fixedly or removeably attached to lower ledges 118*e*, 118*f* formed at the base of sidewalls 118*b*, 118*d*, respectively, and biased against the shaft shield 125, thereby biasing the cover in the first, closed orientation. The second flange 129*b* of the biasing member 129 may also have a curvature complementary to the curvature of the shaft shield 125, thereby permitting rotation of the shaft shield 125 relative to the biasing member 129 upon opening and/or closing of the cover 124. In such an embodiment, to open the cover 124, a user must initially overcome the biasing force of the biasing member 129.

With continued reference to FIGS. 13-15, one embodiment includes a front aperture 120 defined by one of the one or more sidewalls 118 and the cover 124. The aperture 120 has a diameter sufficient for receiving a smoking article 111. In embodiments in which the cover is not openable, a larger aperture may be desirable in order to accommodate smoking articles of any diameter. In another embodiment, the aperture 120 may be formed entirely within one of the sidewalls 118 (not shown).

In alignment with the aperture 120 is a smoking article support 126 extending substantially horizontally into the partially enclosed volume of the housing 112. In the embodiment depicted in FIGS. 13-18, the smoking article support 126 serves as a cradle for a lit smoking article 111, permitting a lit end of the smoking article 111 to be suspended within the housing 112 and in alignment with the receptacle 114. Thus, when ash or debris falls from the end of a lit smoking article 111, it is captured by the receptacle 114.

With continued reference to FIGS. 16-18, a removable tray 130 may be disposed within the housing 112 for receiving ash and debris from the lit end of a smoking article 111. In one embodiment, tray 130 is slidably received by the receptacle 114, thereby permitting the removal and disposal of ash and debris from the ashtray 110. Tray 130 may include a raised stop 134 for aiding the alignment of the cover 124 relative to the housing 112 and concealing the biasing member 129. Raised stop 134 may also prevent ash from being released from the receptacle 114 upon opening and closing the cover 124.

In one embodiment, depicted in FIGS. 16-18, a retention member 128 extending from the interior surface of the cover 124 proximate the smoking article support 126 secures or presses the smoking article 111 against the smoking article support 126 when the cover 124 is in the first, closed position. The retention member 128 may provide a force great enough to retain smoking articles 111 having varying diameters, such as a cigar or a narrower cigarette, in place during use, but may also be flexible enough not to crush or damage the smoking article 111. In use, disengaging the cover 124 from the upper edges of the one or more sidewalls 118 via the lever arm 122 increases a distance between the retention member 128 and the smoking article support 126, thereby releasing the smoking article 111 and permitting it to be removed from the ashtray 110. When associated with smoking articles 111 having a diameter too great to permit the complete closing of the cover 124, the retention member 128 serves to hold the smoking article 111 in place.

Referring again to FIGS. 14 and 15, another embodiment may include a detachable base portion 116 for receiving the housing 112 or the receptacle 114. The base portion 116 may aid in increasing the stability of the ashtray 110 when placed upon a surface. In one embodiment depicted in FIGS. 13 and 14, the base portion 116*a* is substantially rectangular and may further comprise an attachment material (not shown) for removeably associating the base portion 116*a* with a surface. In another embodiment depicted in FIG. 15, the base portion 116*b* may be substantially circular and sized for placement in an existing circular space, such as vehicular cup holder and the like. Other base portion shapes, however, are considered to be within the scope of the present disclosure.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made during the pendency of this application and all equivalents of those claims as issued.

What is claimed is:

1. An ashtray for holding a smoking article, the ashtray comprising:
   - a housing defined by a receptacle and one or more sidewalls upstanding therefrom, one or more upper edges of the one or more sidewalls defining a top opening;
   - a cover having interior and exterior surfaces and being movable between a first position wherein it is in substantial covering engagement with the top opening, and a second position wherein it is substantially disengaged from the top opening, the cover adapted to fit over the top opening to form a partially enclosed volume bounded by the housing and the cover;
   - at least one lever arm operatively associated with the cover to permit the cover to be moved between the first and second positions;
   - the cover including at least one journal for operably engaging a central shaft;
   - a shaft shield integral with the interior surface of the cover, the shaft shield protecting the central shaft from heat from the smoking article.

2. An ashtray, comprising:
   - a housing having a receptacle and one or more sidewalls upstanding therefrom, one or more upper edges of the one or more sidewalls forming a top opening;
   - a cover having interior and exterior surfaces, the cover adapted to fit over the top opening in substantial covering engagement to form a partially enclosed volume bounded by the housing and the cover;
   - an aperture defined by one of the one or more sidewalls and the cover, the aperture having a diameter sufficient for receiving a smoking article;
   - a smoking article support extending substantially horizontally into the partially enclosed volume of the housing, the smoking article support permitting a lit end of the smoking article to be suspended within the housing;
   - at least one lever arm operable with a central shaft for disengaging the cover from the one or more upper edges of the one or more sidewalls;
   - the cover including at least one journal for operably engaging the at least one central shaft;
   - a shaft shield integral with the interior surface of the cover, the shaft shield protecting the at least one central shaft from heat from the smoking article.

3. The ashtray as described in claim 2, an interior partition wall operably engaging both the at least one journal and the shaft shield.

4. The ashtray as described in claim 2, further comprising a curved tension plate extending from the interior surface of the cover proximate the smoking article support, the curved tension plate securing the smoking article against the smoking article support.

5. The ashtray as described in claim 2, further comprising a removable tray slidably received by the receptacle, the removable tray receiving ash from the lit end of the smoking article.

6. The ashtray as described in claim 2, further comprising a base portion for receiving the housing.

7. The ashtray as described in claim 6, wherein the base portion is at least one of substantially rectangular and substantially circular.

8. The ashtray as described in claim 7, the base portion further comprising an attachment material operable for securing the ashtray to a surface.

9. The ashtray as described in claim 2, wherein the cover further comprises one of one or more sidewalls.

10. An ashtray comprising:

a housing defining an opening;

a cover adapted to fit over the opening in substantial covering engagement to form a partially enclosed volume bounded by the housing and the cover;

an aperture defined by at least one of the housing and the cover, the aperture adapted for receiving a smoking article;

a support extending into the partially enclosed volume of the housing, the support permitting a lit end of the smoking article to be suspended within the housing;

at least one lever arm operable with a central shaft for disengaging the cover from the opening;

the cover including at least one journal for operably engaging the at least one central shaft;

a shaft shield integral with the cover, the shaft shield protecting the at least one central shaft from heat from the smoking article.

11. The ashtray as described in claim 10, further comprising a tension member for retaining the smoking article against the support.

12. The ashtray as described in claim 11, wherein the tension member extends from the cover.

13. The ashtray as described in claim 12, wherein disengaging the cover from the housing increases a distance between the tension member and the support.

14. The ashtray as described in claim 10, further comprising a removable tray positioned within the housing for receiving ash from the smoking article.

15. The ashtray as described in claim 10, wherein the housing is configured to be received by a cup holder.

16. The ashtray as described in claim 10, further comprising a base portion for receiving the housing.

* * * * *